United States Patent [19]

Herzog

[11] 4,039,120

[45] Aug. 2, 1977

[54] DIVISIBLE CARTON AND BLANK THEREFOR

[75] Inventor: Milton W. Herzog, Valley Stream, N.Y.

[73] Assignee: H. Goodman & Sons, Inc., Kearny, N.J.

[21] Appl. No.: 670,624

[22] Filed: Mar. 26, 1976

[51] Int. Cl.[2] ..... B65D 5/54

[52] U.S. Cl. ..... 206/606; 229/28 R

[58] Field of Search ..... 229/51 DB, 29 B, 28 R, 229/37 R, 15

[56] References Cited

U.S. PATENT DOCUMENTS

| | | | |
|---|---|---|---|
| 2,690,866 | 10/1954 | Kirby | 229/28 R |
| 2,717,115 | 9/1955 | Vines | 229/28 R |
| 2,717,116 | 9/1955 | Vines | 229/28 R |
| 2,944,718 | 7/1960 | Williamson | 229/28 R |
| 3,168,234 | 2/1965 | Bartz | 229/51 DB |
| 3,223,307 | 12/1965 | Kuhlman | 229/28 R |
| 3,246,827 | 4/1966 | Walter | 229/28 R |
| 3,260,441 | 7/1966 | Koltz et al. | 229/28 R |
| 3,847,281 | 11/1974 | Vogeli | 229/28 R |

*Primary Examiner*—Davis T. Moorhead

[57] ABSTRACT

A carton and blank therefor has a transverse tear-strip and panel areas with adjoining ends flaps adapted to be erected adjacent the tear-strip so as to form carton dividers. When the tear-strip is removed, the dividers form end barriers across separated carton sections. Where the tear-strip provides margins for the carton dividers, the tear-strip and the erected dividers form a carton-stiffening channel.

4 Claims, 4 Drawing Figures

FIG. 1
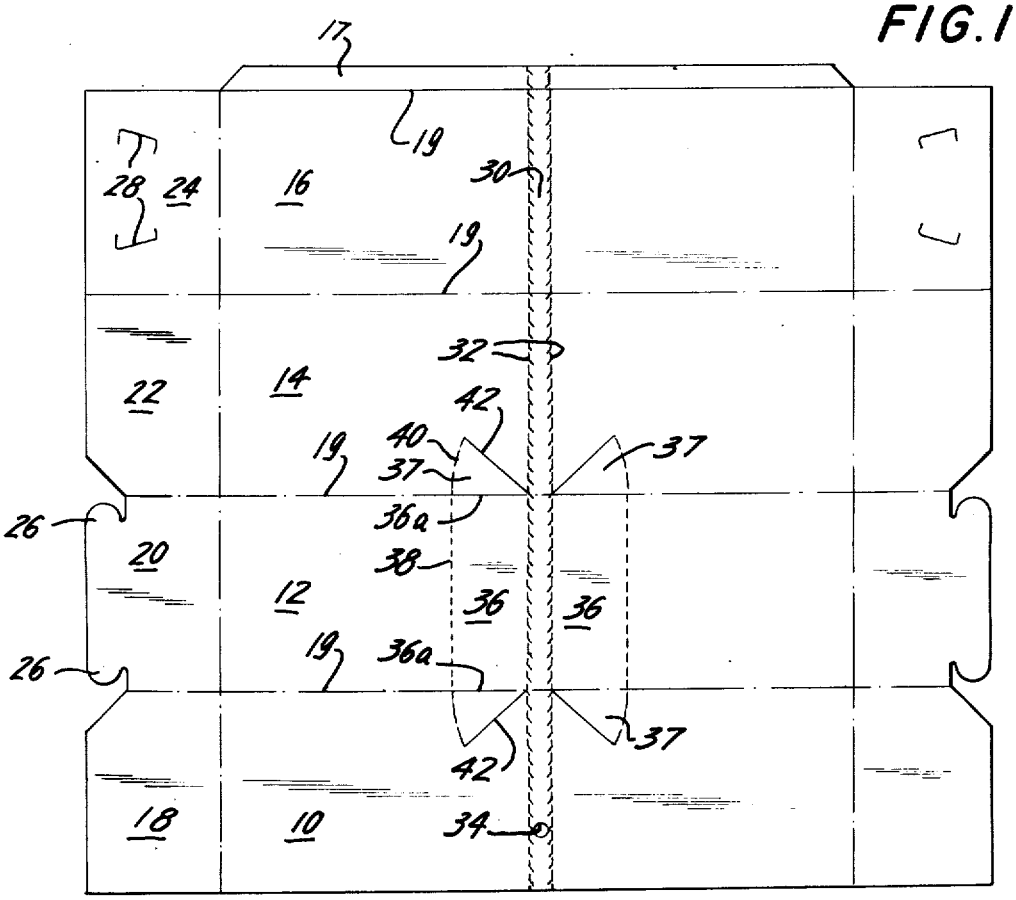
FIG. 2
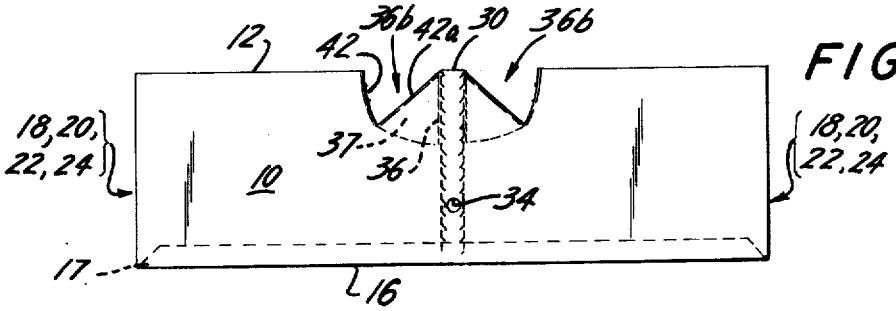
FIG. 3
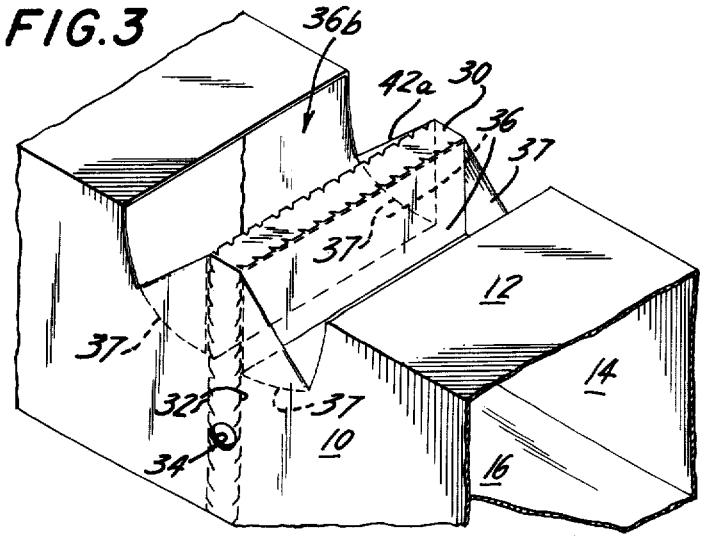
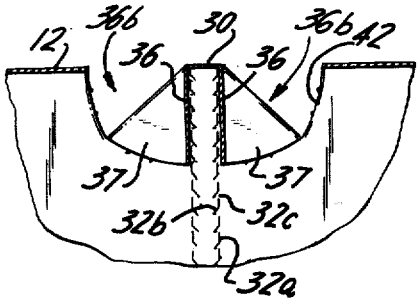
FIG. 4

DIVISIBLE CARTON AND BLANK THEREFOR

FIELD OF THE INVENTION

This invention relates to blanks for forming cartons and to cartons formed by erecting such blanks.

BACKGROUND OF THE INVENTION

A carton made to separate into two parts formed of a single blank, has heretofore been held together by a tear-strip. Removal of the tear-strip yields two separate partial cartons, each having an open end unless a barrier is provided across each open end.

Separately it is known that articles such as apples and bottles can be held in place in a carrier made of cardboard, where there are plural article-retraining straps. Each strap is struck up from a wall of the article carrier, the strap being carried by end flaps formed of material taken from adjoining walls of the article carrier and joined to those walls by bends extending at 45° to the creases between the adjoining walls of the carrier. For the carrier to be used at all, the straps must be erected as described.

SUMMARY OF THE INVENTION

Cartons of the present invention have a wide latitude of flexibility in their use. A single stock of carton blanks can serve as conventional containers, each carton having pairs of side panels and end-closing flaps. The same carton can be used for containing articles in two groups, to be separated into two separately contained groups of articles. One packer at a given packing station, using one supply of cartons, can pack the articles either way to meet changing needs.

The carton has a tear-strip across all of its panels. Each part of the carton at opposite sides of the tear-strip has portions demarked variously by incisions and creases for providing a carton divider, and thus there are two carton dividers, one at each side of the tear-strip. To special advantage, the rows of discontinuous incisions forming the tear-strip serve also as margins of the carton dividers, respectively. Where such dividers extend from opposite margins of a common length of the tear-strip at one panel of the carton, the common length of the tear-strip and the two dividers form a carton-stiffening structure.

The nature of the invention and its various advantages and novel features will be more fully appreciated from the following detailed description of an illustrative embodiment and from the accompanying drawing that shows that embodiment. In the drawing:

FIG. 1 is a plan view of a novel carton blank embodying features of the invention;

FIG. 2 is a lateral elevation of a carton made of the carton blank of FIG. 1;

FIG. 3 is a fragmentary perspective of the carton of FIG. 2, drawn to larger scale; and FIG. 4 is a fragmentary longitudinal cross-section of the carton of FIG. 2, drawn to larger scale, the cross-sectional plane being parallel to the elevation of FIG. 2.

In the drawing, four long and narrow panels 10, 12, 14 and 16, and a lap 17, are divided by score lines or creases 19. Pairs of flaps 18, 20, 22 and 24 extend from the opposite ends of panels 10, 12, 14 and 16, respectively, divided by creases from those panels. Flaps 20 have ears 26 that are shaped and positioned for entry into slits 28 in the flaps 24 of panel 16. Panels 10 and 14 are of equal width and panels 12 and 16 are of equal width.

A tear-strip 30 extends across panels 10, 12, 14 and 16 and lap 17, for dividing the carton into halves in this illustrative embodiment. The tear-strip is defined by two parallel lines of disconnected incisions or slits 32 each having a portion **32*a* along the tear-strip and a portion 32*b* extending from portion 32*a* toward the centerline of the tear-strip. This leaves an integral connection 32*c* between each slit 32*a*, 32*b* and the next slit in each line of slits. Hole 34 in strip 30** provides a convenient starting point for tearing when the carton is to be divided. Perforations can be used instead of the slits.

Each of two areas 36 of panel 12 is defined by a row of incisions 32 and a row of perforations 38 along its length, and by creases or score lines **36*a* across its ends. In this instance, perforations 38 form a line across panel 12 that is straight, but of course this line may have any desired shape. Score lines 36*a* are merely segments of the score lines dividing panel 12 from panels 10 and 14. Flaps 37 are joined to the ends of each area 36. Each flap is of roughly triangular or pie-cut shape, defined by score line or crease 36*a*, arcuate incisions 40, and a score line or crease 42 here extending at 45° to score line 36*a*, extending to the point where score line 36*a* intersects a line of incisions 32 of tear-strip 30**.

Lap 17 is glued to a margin of panel 10. When the carton is to be erected, the end flaps are closed against one another in the conventional manner at both ends of the carton. Of course merchandise is packed in the carton before the end flaps are closed.

When areas 36 are to serve their special purpose, the margins formed by perforations 38 and incisions 40 are torn free and areas 36 are forced out of the plane of panel 12 and toward the interior of the carton. Areas 36 are optionally erected after closing one set of end flaps, but in any case areas 36 are erected before the carton is filled. The angle of creases 42 determines the erection of areas 36. Where the angles between creases 42 and **36*a* is 45° and where incision rows 32 are perpendicular to the panel-dividing score lines 19, the erected dividers are perpendicular to the carton walls. In the illustrated carton, the width of area 36 (along panel 12) is less than half the width of panels 10 and 14, and divider 36 extends nearly halfway across the carton from panel 12 to panel 16**.

When dividers 36 have been set up, they are opposite each other, hinged along tear lines 32, respectively, and spaced apart by the width of the tear-strip. They are firmly fixed in position by respective pairs of flaps 37 which lie against the inside surfaces of panels 10 and 14. The dividers 36 and tear-strip 30 form the walls and the bottom of a channel that constitutes a stiff structure across the carton, the cut-out and erected areas 36 contributing strength to the carton rather than weakening it.

The carton is intended for containing articles or packages that are not free to escape through the openings left by erecting dividers 36. The packages may be long and slender and disposed along the length of the carton parallel either to walls 10 and 14 or to walls 12 and 16. However, the article may be shaped like the transverse cross-section of the carton. In that case, the opening left by each divider 36 can serve as a dispenser slot for articles thinner than the width of the opening. The carton will securely retain articles extending across the carton where the articles are thicker than the width of the opening left by divider 36.

Dividers 36 hold the contents securely in order in each part of the carton, even if some or all of the articles in the other part of the carton have been removed. Opening **36*b*** enable direct-view of the contents of the carton.

Tear-strip 30 can be torn free, to split the carton into two. This may be done when (for example) a half-dozen articles are contained in each half of the carton and a customer's order calls for half a dozen of the articles. After the split, articles appropriately arranged in each part of the carton are snugly retained in the separated carton halves. Divider 36 of each "half-carton" (which has become a separate carton) then serves as an end barrier or a partial wall closing one end of the carton.

The foregoing carton is flexible in use, enabling application at the point of use to serve either as a conventional carton with no openings in its wall, or as a divisible carton with paired carton dividers. Variations will readily be apparent to those skilled in the art, and hence the invention should be construed broadly, in accordance with its full spirit and scope.

What is claimed is:

1. A carton blank, including first and second pairs of elongated panels adjoining one another along parallel margins constituting opposite pairs of panels when the carton is erected, end closure flaps at the opposite ends of the panels for forming carton closures when the blank is erected, said panels and said flaps being divided from each other by score lines, said panels including a tear strip, the tear strip extending across all of said elongated panels spaced from the opposite ends thereof, said tear strip being defined by a pair of discontinuous rows of punctures, and first and second carton-divider areas included in the same one of said panels and disposed respectively at opposite sides of the tear strip, the ends of each carton-divider area being defined by the score lines along the panel containing such carton-divider area, the pair of panels adjoining said one of said panels including a pair of divider flaps extending from the ends of each said carton-divider area, said carton-divider areas and said divider flaps being demarked from their respective panels by lines of weakening including spaced-apart parallel hinge means for said carton-divider areas and respective hinge means for said divider flaps formed at an acute angle to said panel-dividing score lines, said lines of weakening and said hinge means being formed for adapting said carton-divider areas to be erected transverse to the carton and spaced apart at opposite sides of the tear strip for acting when erected as a U-shaped carton-stiffening structure, the width of each carton-divider area measured along its elongated panel being less than about half the width of each of the elongated panels containing its divider flaps and the distance from each carton-divider area to the closet end flap being a major part of the distance between that end flap and the tear strip for providing a substantial length of carton wall for containing articles when the carton is erected, and the carton-divider areas when erected and when the tear strip is removed constituting article-retaining barriers opposite the respective end closures formed by said closure flaps.

2. A carton blank in accordance with claim 1, wherein the rows of slits dividing the tear-strip from the rest of said one of said panels constitute part of said weakening lines of said dividing areas, said hinge means of each carton-divider flap intersecting one of said rows of slits.

3. A carton blank in accordance with claim 1 wherein those parts of the discontinuous rows of punctures which extend across said one of said panels constitute said parallel hinge means of said carton-divider areas.

4. A carton blank in accordance with claim 1, wherein said pairs of panels and said end flaps and said carton-divider areas are erected to constitute a carton and wherein two groups of articles are contained in the two portions of the container formed, respectively, between said erected carton-divider area and a corresponding set of erected end closure flaps, the erected carton-divider areas acting to retain the articles in the two portions of the carton when the tear strip is removed and the carton is thus divided.

* * * * *